US008422928B2

(12) United States Patent
Maruko et al.

(10) Patent No.: US 8,422,928 B2
(45) Date of Patent: Apr. 16, 2013

(54) FIXING UNIT WITH AUXILIARY HEATING MEMBER AND SURFACE RECOVERY MEMBER, AND IMAGE FORMING APPARATUS

(75) Inventors: Masami Maruko, Hachioji (JP); Susumu Okui, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 214 days.

(21) Appl. No.: 12/955,228

(22) Filed: Nov. 29, 2010

(65) Prior Publication Data

US 2011/0129266 A1 Jun. 2, 2011

(30) Foreign Application Priority Data

Dec. 2, 2009 (JP) ..... 2009-274265

(51) Int. Cl.
*G03G 15/20* (2006.01)

(52) U.S. Cl.
USPC ..... 399/326

(58) Field of Classification Search ..... 399/328, 399/326
See application file for complete search history.

(56) References Cited

U.S. PATENT DOCUMENTS 7,224,922 B2 * 5/2007 Kemmochi ..... 399/109

FOREIGN PATENT DOCUMENTS

JP 2-266383 A 10/1990
JP 2008-40363 A 2/2008

* cited by examiner

*Primary Examiner* — Quana M Grainger
(74) *Attorney, Agent, or Firm* — Cantor Colburn LLP

(57) ABSTRACT

A fixing unit is provided with a fixing member to heat a recoding medium and to fix a toner image on the recording medium; a pressure member to press the fixing member to form a nip portion in which a recording medium carrying a toner image is nipped; an auxiliary heating member to heat the surface of the fixing member; and a surface recovery member, arranged at a downstream side of the first auxiliary heating member in a rotational direction of the fixing member, for recovering damage to a surface of the fixing member by making contact with and sliding on the fixing member.

6 Claims, 5 Drawing Sheets

FIXING UNIT WITH AUXILIARY HEATING MEMBER AND SURFACE RECOVERY MEMBER, AND IMAGE FORMING APPARATUS

CROSS REFERENCE TO RELATED APPLICATION

This application is based on Japanese Patent Application No. 2009-274265 filed with Japan Patent Office on Dec. 2, 2009, the entire content of which is hereby incorporated by reference.

BACKGROUND OF THE INVENTION

1. Field of the Invention

The present invention relates to a fixing unit to fix a toner image on a recording medium by heating and pressing the recording medium, and an image forming apparatus provided with the fixing unit.

2. Description of Related Art

An image forming apparatus of an electrophotographic system such as a copier, a printer, and a facsimile machine, as well as a multifunction peripheral having such functions is available. In the fixing unit of this image forming apparatus, a heat roller system using a heat roller serving as a fixing member is widely used. For example, a fixing unit of this heat roller system is used in machines ranging from low-speed machines to high-speed machines and further from monochrome machines to color machines. The heat roller is also referred to as a fixing roller, and the heat roller system is also referred to as a heat-fixing roller system.

A fixing unit of such a heat roller system is provided with a fixing roller which is kept at a predetermined temperature and a pressure roller as a pressure member having an elastic layer. A recording medium on which an unfixed toner image has been formed is conveyed while being nipped by a fixing nip portion formed by the fixing roller and the pressure roller. Then, the fixing unit of the heat roller system heats and presses the thus-conveyed recording medium.

Over recent years, instead of the above fixing roller, an endless fixing belt stretched by at least two rollers is being used as a fixing member. A belt fixing unit having such a fixing belt is provided with a pressure roller, serving as a pressure member, to press the fixing belt. A recording medium on which an unfixed toner image has been formed is heated and pressed by a fixing nip portion formed by the fixing belt having been heated by at least one of the rollers stretching the fixing belt and the pressure roller.

As a recording medium is conveyed to the fixing unit in this manner, the surface of the fixing member is damaged by the recording medium and then gradually roughened. The damage is mainly caused by burrs of both edges of the recording medium produced during cutting of the recording medium. Namely, when a recording medium is conveyed to the fixing unit, buns in both edges of the recording medium in the longitudinal direction of the fixing roller roughen the surface of the fixing member. Especially when recording media of the same size are continuously conveyed to the fixing unit, locations of the fixing member corresponding to both edges of the recording media, namely, locations of the fixing member through which the above burrs are passed are damaged, resulting in the state of being roughened. Such roughness of the surface of the fixing member produces gloss non-uniformity in an image to be fixed on a recording medium, resulting in occurrence of image degradation.

Therefore, for example, as a related technology, Unexamined Japanese Patent Application Publication (hereinafter referred to as JP-A) No. 2-266383 describes a fixing unit having a web to clean a fixing roller. A metal is attached to this web at a rate of 0.5 through 1.5 g/m$^2$. The web grinds the fixing roller serving as a fixing member, whereby the surface of the fixing roller is uniformed. Thereby, the smoothness (hereinafter referred to as surface property) of the surface of the fixing roller is recovered. However, the inventors of the present invention found a problem in which grinding of the fixing roller shortened the lifetime of the fixing roller.

Further, for example, as another related technology, JP-A No. 2008-40363 describes an image heating unit (namely, a fixing unit) having a heating rotating body (namely, a fixing roller) to heat an image on a recording medium at a nip portion and a friction sliding section to recover the surface property of the heating rotating body.

It is disclosed therein that this friction sliding section has a friction sliding layer formed by adhesion of dense abrasive grains, and the heating rotating body is subjected to scratches by the friction sliding section, whereby the surface property of the heating rotating body is recovered, namely, the friction sliding section produces a large number of fine scratches on the surface of the fixing roller, whereby the surface property of the fixing roller is recovered.

However, repetitive recovery operations of the surface property of the fixing roller cause contamination of the friction sliding section. Namely, the inventors of the present invention found that since the friction sliding section was contaminated, the roughness of the friction sliding section was unable to be maintained, whereby the recovery function of the friction sliding section was decreased.

SUMMARY OF THE INVENTION

An object of the present invention is to provide a fixing unit enabling to maintain the recovery function of a friction sliding section for a long period of time by extending the lifetime of the friction sliding section to recover the surface property of a fixing member and an image fowling apparatus provided with the fixing unit.

The above object is achieved by the following constitution:

According to a first aspect of the present invention, a fixing unit incorporates a fixing member to heat a recording medium and to fix a toner image on the recording medium; a pressure member to press the fixing member to form a nip portion in which a recording medium carrying a toner image is nipped; a first auxiliary heating member to heat the surface of the fixing member; and a first surface recovery member, which is arranged at a downstream side of the first auxiliary heating member in a rotational direction of the fixing member, for recovering damage to a surface of the fixing member by making contact with and sliding the fixing member.

According to a second aspect of the present invention, an image forming apparatus incorporates a transfer section to transfer a toner image onto a recording medium; a fixing member to heat a recording medium on which a toner image has been transferred by the transfer section and to fix the toner image on the recording medium; a pressure member to press the fixing member to form a nip portion in which a recording medium carrying a toner image is nipped; a first auxiliary heating member to heat the surface of the fixing member; and a first surface recovery member, which is arranged at a downstream side of the first auxiliary heating member in a rotational direction of the fixing member, for recovering damage to a surface of the fixing member by making contact with and sliding the fixing member.

BRIEF DESCRIPTION OF DRAWINGS

These and other objects, advantages and features of the invention will become apparent from the following description thereof taken in conjunction with the accompanying drawings.

DETAILED DESCRIPTION OF THE PREFERRED EMBODIMENTS

Hereinbelow, typical embodiments of the present invention will be explained with reference to the drawings. It should be note that the present invention is not limited to the embodiments described below. Definitions of terms described below are given by way of explanation of the terms only, and thus the definitions of the terms of the inventions are not limited thereto.

Realization of a long lifetime of a friction sliding section is achieved, for example, by extending the duration till the friction sliding section cannot be used due to contamination of the friction sliding section. Namely, as to the realization of a long lifetime of the friction sliding section, it is effective that the speed of contamination of the friction sliding section is reduced to the lowest level possible.

Therefore, the inventors of the present invention conducted investigations to shorten the duration of a recovery operation to recover the surface property of a fixing member. Namely, the inventors of the present invention conducted investigations to shorten the duration, in which a friction sliding section is in contact with a fixing member, by effectively carrying out the recovery operation of the surface of the fixing unit using the friction sliding section.

Thus, the inventors of the present invention discovered that the surface temperature of the fixing member was kept at the fixing temperature or higher to carry out a recovery operation, whereby the duration of the recovery operation was able to be shortened, resulting in a shortened duration in which the friction sliding section was in contact with the fixing member.

Embodiments of a fixing unit according to the present invention will now be described with reference to the drawings. However, the present invention is not limited to the following embodiments.

Figure 1:
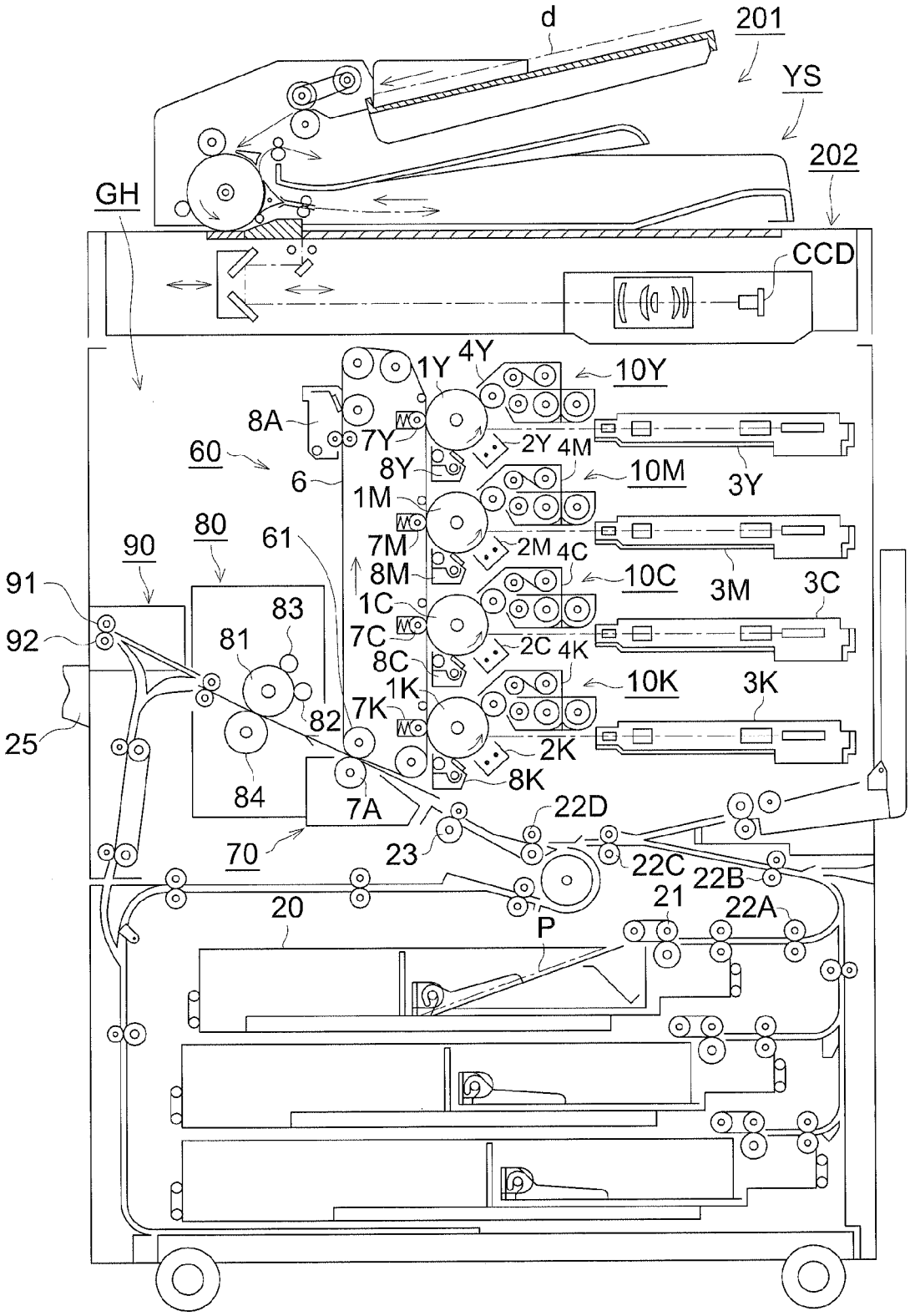
FIG. 1 is a schematic view illustrating one example of an image forming apparatus provided with a fixing unit according to the present invention.

FIG. 1 is a schematic view illustrating one example of an image forming apparatus provided with a fixing unit according to the present invention.

An image forming apparatus according to the present invention incorporates an image forming apparatus main body GH and an image reading apparatus YS. The image forming apparatus main body GH is referred to as a tandem-type color image forming apparatus. The image forming apparatus GH incorporates, for example, a plurality of image forming sections 10Y, 10M, 10C, and 10K, an intermediate transfer unit 60 having an intermediate transfer belt 6 as an intermediate transfer body on an endless belt, a transfer device 70, a sheet feed conveyance section, a fixing unit 80, and a sheet discharging unit 90.

On top of the image forming apparatus main body GH, the image reading apparatus YS having an automatic document feeder 201 and a document image scanning exposure device 202 is placed. An original document d having been placed on the document platen of the automatic document feeder 201 is conveyed by the conveyance section and then an image on one side or on each of both sides of the original document is scanning-exposed using the optical system of the document image scanning exposure device 202. The image having been scanning-exposed by the document image scanning exposure device 202 is read by a line image sensor CCD.

Signals having been photoelectrically converted by the line image sensor CCD are subjected to, for example, analog processing, A/D conversion, shading compensation, and image compression processing in an image processing section, and thereafter sent to exposure sections 3Y, 3M, 3C, and 3K.

The image forming section 10Y, forming a yellow (Y) color image, has, in the periphery of a photoreceptor drum 1Y, a charging section 2Y, an exposure section 3Y, a developing device 4Y, and a cleaning section 8Y. The image forming section 10M, forming a magenta (M) color image, has, in the periphery of a photoreceptor drum 1M, a charging section 2M, an exposure section 3M, a developing device 4M, and a cleaning section 8M. The image forming section 10C, forming a cyan (C) color image, has, in the periphery of a photoreceptor drum 1C, a charging section 2C, an exposure section 3C, a developing device 4C, and a cleaning section 8C. The image forming section 10K, forming a black (Bk) color image, has, in the periphery of a photoreceptor drum 1K, a charging section 2K, an exposure section 3K, a developing device 4K, and a cleaning section 8K. The charging section 2Y and the exposure section 3Y constitute a latent image forming section.

In the same manner, a latent image forming section of each of magenta, cyan, and black incorporates a charging section and an exposure section for each color.

The latent image forming section of each color forms a latent image on each corresponding photoreceptor drum. Then, the developing device of each color forms an individual color image on each photoreceptor drum.

Images of the individual colors having been formed by the image forming sections 10Y, 10M, 10C, and 10K are sequentially superimposed on the intermediate transfer belt 6, rotated with a plurality of rollers, by transfer sections 7Y, 7M, 7C, and 7K. This is referred to as primary transfer.

A recording medium P stored in a sheet feed cassette 20 is fed by the sheet feed section 21 and conveyed to the transfer device 70 via sheet feed rollers 22A, 22B, 22C, and 22D), as well as a registration roller 23. Then, a color image having been superimposed on the intermediate transfer belt 6 via the primary transfer is transferred onto the recording medium P in the transfer section 70. This is referred to as secondary transfer.

After the secondary transfer, the recording medium P on which the color image has been transferred is conveyed to the above fixing unit 80. The fixing unit 80 heats and presses the recording medium P to fix the color image on the recording medium P thereon.

The recording medium P having been discharged from the fixing unit 80 is nipped by a sheet discharging roller 91 and a corrugation roller 92 serving as a pinch roller of the sheet discharging unit 90 and then discharged onto a sheet discharging tray 25 outside the apparatus.

On the other hand, after the color image has been transferred onto the recording medium P by the transfer device 70, the residual toner on the intermediate transfer belt 6 from which the recording medium P has been curvature-separated is eliminated by a cleaning section 8A.

Next, one example of a fixing unit according to the present invention will now be described.

Figure 2:
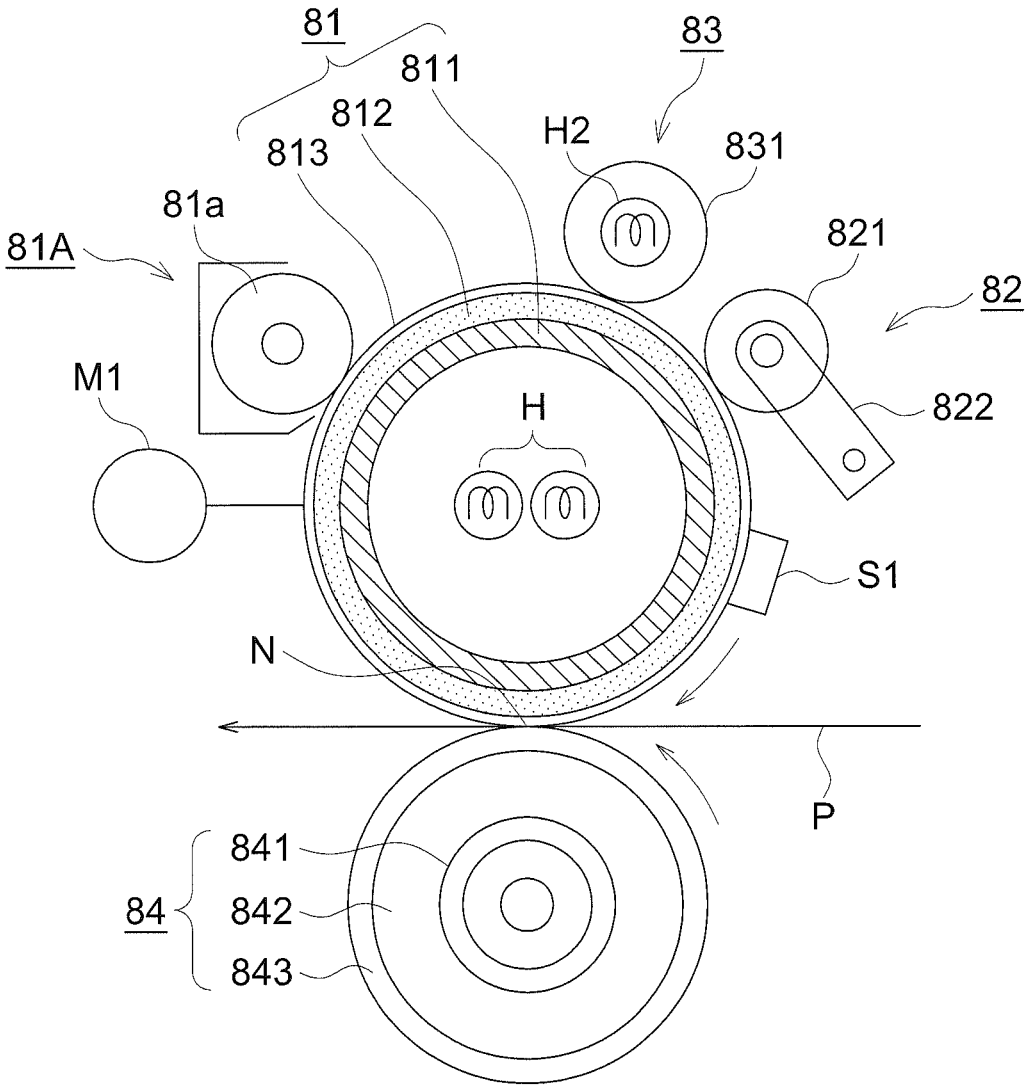
FIG. 2 is a view illustrating one example of the main constitution of a fixing unit according to the present invention.

FIG. 2 is a view illustrating one example of the main constitution of a fixing unit according to the present invention.

The fixing unit 80 is provided with a fixing roller 81 as a fixing member having a heating member therein and a pressure roller 84 as a pressure member to form a fixing nip portion N by contact with the fixing roller 81. Further, the fixing unit 80 is provided with a surface recovery member 82 to rub or scratch the fixing roller 81 to recover the surface property thereof and an auxiliary heating member 83 to heat the fixing roller 81. The fixing unit 80 heats and presses a toner image formed of an unfixed toner on a recording medium P in the fixing nip portion P to fix the toner image on the recording medium P. Herein, the fixing roller 81 and a heating source function as heating members, and the pressure roller 84 functions as a pressure member.

The pressure roller 84 is supported by a supporting member (not shown) so as to be brought into contact with and withdrawn from the fixing roller 81. Further, the pressure roller 84 is constituted as a soft roller.

The pressure roller 84 is constituted, for example, of a hollow core metal 841, an elastic layer 842 provided on the outer circumferential surface of the core metal 841, and a releasing layer 843 provided on the outer circumferential surface of the elastic layer 842.

The core metal 841 is formed of a pipe of metal such as an aluminum alloy, carbon steel, or stainless steel.

The elastic layer 842 is formed of a sponge-like synthetic rubber having continuous foam-type porous properties of a pore size of 0.01 mm through 0.5 mm. The rubber hardness of the elastic layer 842 is 20 through 40° C. in terms of ASKER C hardness. The wall thickness of the elastic layer 842 is 3 mm through 10 mm.

The outer circumferential surface of the releasing layer 843 is formed of a PFA (polytetrafluoroethylene) tube having holes of a diameter of 0.01 μm through 1 μm. The thickness of the releasing layer 843 is 30 μm.

The fixing roller 81 houses a halogen heater H as a heating source therein. The fixing roller 81 is constituted, for example, of a cylindrical core metal 811, an elastic layer 812 to cover the cylindrical core metal 811, and a releasing layer 813 to cover the elastic layer 812.

For example, the cylindrical core metal 811 is formed of aluminum or iron metal. The elastic layer 812 is formed of HTV (High Temperature Vulcanization) silicon rubber exhibiting enhanced heat resistance. The releasing layer 813 is formed of a fluorine resin such as PFA (perfluoroalkyl vinyl ether) or PTFE (pertetrafluoroethylene).

In one embodiment of the present invention, the fixing roller 81 is formed as follows. In the shape of the fixing roller 81, as a whole, the outer diameter is 65 mm and the width is 360 mm. The cylindrical core metal 811 is foliated of aluminum of a thickness of 5 mm. The elastic layer 812 is formed of silicon rubber of a layer thickness of 1.5 mm. The releasing layer 813 is formed of a PFA tube of a layer thickness of 30 μm.

The fixing roller 81 is rotationally driven by a motor M1 as a drive section.

A temperature sensor S1 detects the surface temperature of the fixing roller 81. A control section (not shown) of the apparatus controls the surface temperature of the fixing roller 81.

A cleaning section 81A has, for example, a cleaning brush 81*a* as a cleaning member. Toner and paper powder having adhered to the surface of the fixing roller 81 is eliminated by the cleaning brush 81*a*.

An auxiliary heating member 83 is provided with a cylindrical auxiliary heating roller 831 formed of metal such as aluminum or iron. A halogen heater H as a heating source is built in the auxiliary heating roller 831. The auxiliary heating roller 831 is supported by a supporting member (not shown) so as to be brought into contact with and withdrawn from the fixing roller 81.

Herein, the fixing roller is mainly heated by the halogen heater H. However, for example, when recording media P are continuously passed through the fixing roller 81, the surface temperature of the fixing roller 81 is decreased below the fixing temperature. Further, for example, when the pressure roller 84 having been withdrawn is brought into contact with the fixing roller 81, the surface temperature of the fixing roller 81 is decreased below the fixing temperature.

The auxiliary heating member 83 heats the surface of the fixing roller 81 to prevent the decrease of the surface temperature described above. Further, when a surface recovery member 82 recovers the surface property of the fixing roller 81, the auxiliary heating member 83 maintains the surface temperature of the fixing roller 81 at the fixing temperature or higher.

In one embodiment of the present invention, the auxiliary heating member 83 is provided with an auxiliary heating roller 831. However, this embodiment is not limited thereto. Instead of the auxiliary heating roller 831, for example, usable is a non-contact heating heater or an endless heating belt stretched by a heating roller and a tension roller.

The surface recovery member 82 is provided with a cylindrical refreshing roller 821 as a friction sliding section.

The refreshing roller 821 is supported by a supporting member 822 so as to be brought into contact with and withdrawn from the fixing roller 81. The refreshing roller 821 is brought into contact with the fixing roller 81 during the recovery operation to recover the surface property of the fixing roller 81 and withdrawn from the fixing roller during the time other than the recovery operation. The refreshing roller 821 is constituted of metal, for example, stainless steel. Further, the refreshing roller 821 has a blast-processed surface, having a surface roughness Ra (a center line average roughness based on JIS B 0601-1982) of 0.3 μm through 1.0 μm.

The surface recovery member 82 is arranged on the rotational direction downstream side of the fixing roller 81 in the vicinity of the auxiliary heating member 83. During the recovery operation, the refreshing roller 821 is rotationally driven by a drive section (not shown). In this case, the rotational direction of the refreshing roller 821 is not specifically limited, being appropriately set based on the specifications of the apparatus As described above, when recording media P of the same size are continuously passed through the fixing roller 81, locations of the fixing roller 81 corresponding to both edges of the recording media, namely, locations through which burrs thereof are passed are damaged, resulting in the state of being roughened. Such roughness of the surface of the fixing roller 81 causes gloss non-uniformity in an image to be fixed on the recording media P, resulting in occurrence of image degradation.

Therefore, the refreshing roller 821 makes contact with and slides the surface of the fixing roller 81 so as to recover the surface property of the fixing roller 81.

Specifically, the refreshing roller 821 produces a large number of fine scratches on both the surface of the fixing roller 81 having been roughened by passing of a recording medium P and the surface of the non-roughened surface of the fixing roller 81. Namely, the surface state of the fixing roller 81 becomes uniformed, whereby the surface property of the fixing roller 81 is recovered.

Thereby, gloss non-uniformity due to the roughness of the surface of the fixing roller 81 is inhibited, resulting in inhibition of image degradation.

A recovery operation to recover the surface property of the fixing roller 81 is preferably carried out when no recording medium P is passed between the fixing roller 81 and the pressure roller 84 (hereinafter referred to as non-sheet-feeding time). A recovery operation during the non-sheet-feeding time can prevent the refreshing roller 821 from being contaminated with offset toner.

Such a recovery operation may be carried out in a periodically automatic manner, for example, based on the number of sheets counted in which the control section of the apparatus counts the number of prints. Alternatively, a recovery operation may be carried out, for example, based on the instruction of the user to initiate the recovery operation when the user has been conscious about gloss non-uniformity of an image by observing the image on a recording medium P.

The purpose of using the refreshing roller 821 is to uniform the surface property of the fixing roller 81 by producing fine scratches on the surface of the fixing roller 81, being not to create a fresh surface by shaving off the surface of the fixing roller 81. However, since the refreshing roller 821 has damaged the fixing roller 81, it is hard to say that the surface of the fixing roller 81 has not been shaved at all.

Therefore, when the recovery operation is repeatedly carried out, then the roughness of the surface of the refreshing roller 821 cannot be maintained due to contamination and abrasion, whereby the recovery function of the refreshing roller 821 is decreased.

In a fixing unit of one embodiment of the present invention, based on the above finding, the surface recovery member 82 is arranged on the rotational direction downstream side of the fixing unit 81 in the vicinity of the auxiliary heating member 83. Thereby, the refreshing roller 821 of the surface recovery member 82 makes contact with the fixing roller 81 whose surface has been heated by the auxiliary heating member 83, whereby the recovery operation can efficiently be carried out.

Further, the surface temperature of the fixing roller 81 heated by the auxiliary heating member 83 is appropriately set based on the design specifications with respect to each machine model and experiments. For example, the surface temperature of the fixing roller 81 is 170° C. during fixing and 210° C. during the recovery operation.

In this manner, the surface temperature of the fixing roller 81, namely, the surface temperature of the releasing layer 813 is set higher during the recovery operation than during fixing. Thereby, a recovery operation is carried out in the state where the surface of the releasing roller 813 is allowed to be softer than during fixing, whereby the surface property of the fixing roller 81 is easily uniformed, resulting in shortening the recovery operation time.

As a result, the time in which the refreshing roller 8211 is in contact with the fixing roller 81 can be shortened, whereby the lifetime of the refreshing roller 821 can be extended. In other words, the number of times in which the releasing roller 821 can carry out a recovery operation can be increased.

Figure 3:
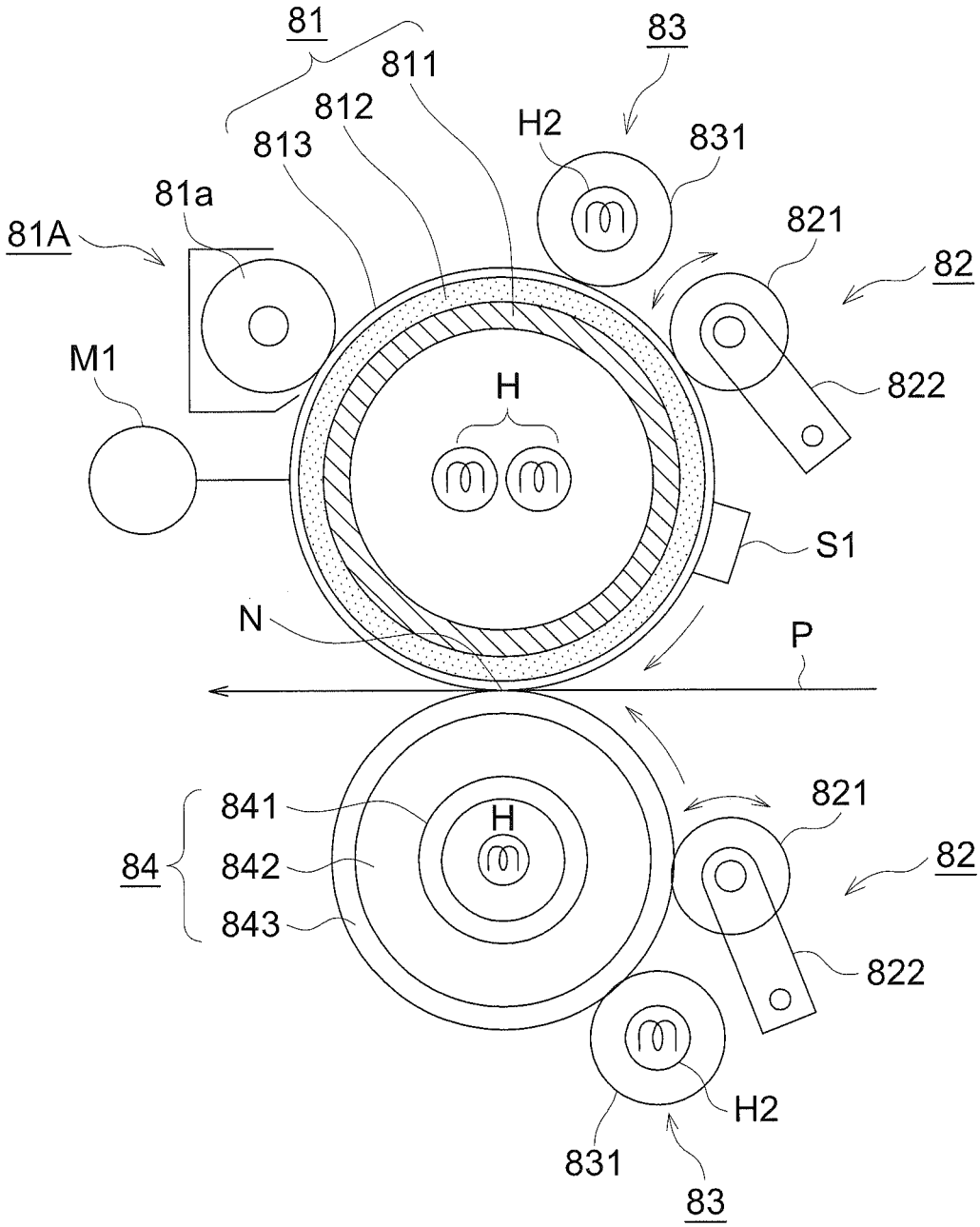
FIG. 3 is a view illustrating one example of the main constitution of another configuration of a fixing unit according to the present invention.
Figure 4:
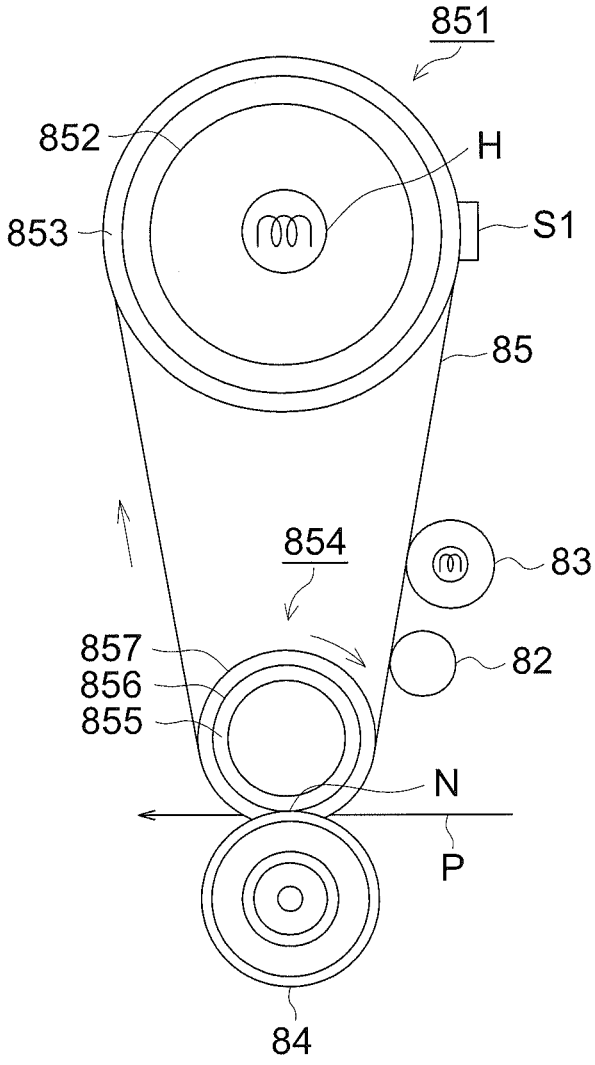
FIG. 4 is a view illustrating one example of the main constitution of another configuration of a fixing unit according to the present invention.
Figure 5:
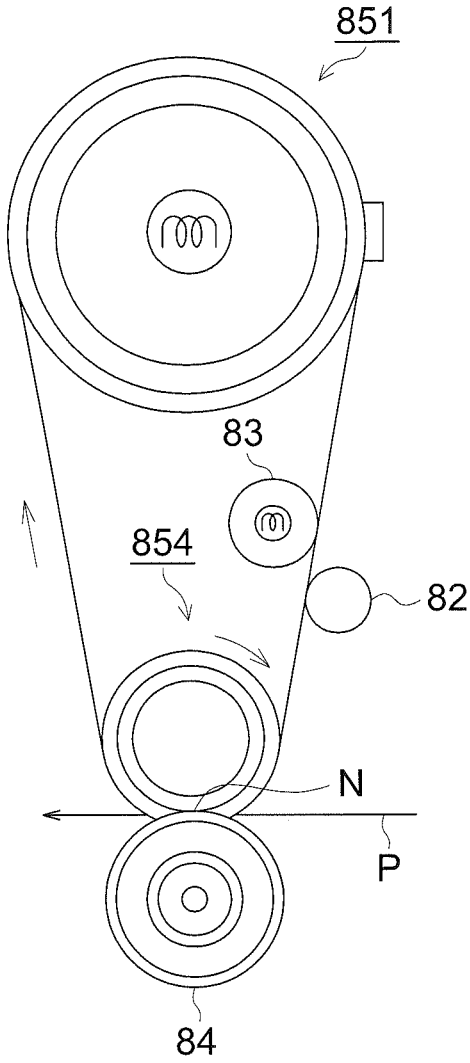
FIG. 5 is a view illustrating one example of the main constitution of another configuration of a fixing unit according to the present invention.

FIG. 3 through FIG. 5 are views illustrating the main constitution of another configuration of a fixing unit according to the present invention. Another configuration thereof each is built in the image forming apparatus GH instead of the fixing unit of FIG. 2.

FIG. 3 is an example in which a surface recovery member 82 and an auxiliary heating member 83 are provided for the pressure roller 84. Thereby, even if the pressure roller 84 is damaged by scratches having been produced in the fixing roller 81, the surface property of the pressure roller 84 is recovered and uniformed by the surface recovery member 82.

FIG. 4 is an example in which instead of the fixing roller 81, an endless fixing belt 85 is used. A surface recovery member 82 and an auxiliary heating member 83 are arranged on the outer circumferential surface of the fixing belt 85. Herein, in FIG. 4, the cleaning section is omitted.

For the fixing belt 85, for example, a heat-resistant resin belt is basically used. This resin belt is formed, for example, of polyimide or polyimide of an inner diameter of 70 through 120 mm and a thickness of 40 through 150 μm. A heat-resistant silicon rubber of 100 through 300 μm covers the outer circumferential surface of the resin belt. Further, the outer circumferential surface of the silicon rubber is coated with PFA (perfluoroalkoxy) of a thickness of 30 through 50 μm as a releasing layer or is covered with a tube thereof.

A heating roller 851 houses a halogen heater H as a heating source therein. The heating roller 851 is provided with a cylindrical hollow rotating body 852 formed of metal such as an aluminum alloy, carbon steel, or stainless steel. A heating-resistant PFA tube covers the outer circumferential surface of the hollow rotating body 852. The outer diameter of the heating roller 851 is, for example, 25 through 70 mm.

Herein, the supporting shaft (not shown) of the heating roller 851 is provided with an energizing section (not shown). This energizing section energizes the heating roller 851 upward.

A fixing roller 854 is constituted as a soft roller. For example, the fixing roller 854 incorporates a cylindrical metal pipe 855 formed of an aluminum alloy or carbon steel, a silicon rubber layer 856 placed on the outer circumferential surface of the metal pipe 855, and a silicon sponge layer 857 placed on the outer circumferential surface of the silicon rubber layer 856. For example, the wall thickness of the aluminum alloy is 2 through 5 mm. Further, the thickness of the silicon rubber layer 856 is 4.5 mm and the outer diameter of the silicon sponge layer 857 is 20 through 50 mm.

FIG. 5 is an example in which the auxiliary heating member 83 shown I FIG. 4 is arranged on the inner circumferential surface of the above fixing belt 85. Compared to the example shown in FIG. 4, a surface recovery member 82 is arranged close to the auxiliary heating member 83. Such an arrangement makes it possible to allow the apparatus to be compact.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

The invention claimed is:

1. A fixing unit comprising:

a fixing member to heat a recoding medium and to fix a toner image on the recording medium;

a pressure member to press the fixing member to form a nip portion at which a recording medium carrying a toner image is nipped;

a first auxiliary heating member to heat a surface of the fixing member;

a first surface recovery member, arranged at a downstream side of the first auxiliary heating member in a rotational direction of the fixing member, for recovering damage to a surface of the fixing member by making contact with and sliding on the fixing member;

a second auxiliary heating member to heat the surface of the pressure member; and a second surface recovery member, arranged at a downstream side of the second auxiliary heating member in a rotational direction of the pressure member, for recovering damage to a surface of the pressure member by making contact with and sliding the pressure member.

2. The fixing member described in claim 1, wherein a recovery operation of the first surface recovery member is carried out when no recording medium is passed between the fixing member and the pressure member.

3. The fixing member described in claim 1, wherein the first surface recovery member is provided with a first friction sliding section for recovering the damage to a surface of the fixing member and the first friction sliding section can be brought into contact with the fixing member and withdrawn from the same.

4. An image forming apparatus comprising:

a transfer section to transfer a toner image on a recording medium;

a fixing member to heat a recording medium on which a toner image has been transferred from a transfer section and to fix a toner image on the recording medium;

a pressure member to press the fixing member to form a nip portion at which a recording medium carrying a toner image is nipped;

a first auxiliary heating member to heat the surface of the fixing member;

a first surface recovery member, arranged at a downstream side of the first auxiliary heating member in a rotational direction of the fixing member, for recovering damage to a surface of the fixing member by making contact with and sliding on the fixing member a second auxiliary heating member to heat the surface of the pressure member; and a second surface recovery member, arranged at a downstream side of the second auxiliary heating member in a rotational direction of the pressure member, for recovering damage to a surface of the pressure member by making contact with and sliding on the pressure member.

5. The image forming apparatus described in claim 4, wherein a recovery operation of the first surface recovery member is carried out when no recording medium is passed between the fixing member and the pressure member.

6. The image forming apparatus described in claim 4, wherein the first surface recovery member is provided with a first friction sliding section for recovering the damage to a surface of the fixing member and the first friction sliding section can be brought into contact with the fixing member and withdrawn from the same.

* * * * *